US005524672A

United States Patent [19]

Mosing et al.

[11] Patent Number: 5,524,672

[45] Date of Patent: Jun. 11, 1996

[54] CASING THREAD PROTECTOR

[76] Inventors: Donald E. Mosing, 623 Roselawn Blvd., Lafayette, La. 70503; Charles Sodha, 330 Fue Folle Rd., Apt. 309, Lafayette, La. 70508

[21] Appl. No.: 215,696

[22] Filed: Mar. 22, 1994

[51] Int. Cl.[6] ..... B65D 59/00

[52] U.S. Cl. ..... 138/96 T; 138/96 R; 138/110

[58] Field of Search ..... 138/96 T, 96 R, 138/99, 110; 215/329, 275, 43; 166/243

[56] References Cited

U.S. PATENT DOCUMENTS

| | | | |
|---|---|---|---|
| 1,349,789 | 8/1920 | Schirra . | |
| 1,756,167 | 4/1930 | Avery | 138/96 T |
| 2,175,414 | 10/1939 | Stevenson | 138/96 T |
| 2,196,454 | 4/1940 | Kahn et al. | 138/96 T |
| 2,880,761 | 4/1959 | Peter | 138/96 T |
| 3,038,502 | 6/1962 | Hauk et al. | 138/96 T |
| 4,233,469 | 11/1980 | Steppe | 138/96 T |
| 4,349,048 | 9/1982 | Clark | 138/96 |
| 4,354,529 | 10/1982 | Soutsos et al. | 138/96 T |
| 4,616,679 | 10/1986 | Benton | 138/96 |
| 4,697,830 | 10/1987 | Wood et al. | 138/96 T |
| 4,889,167 | 12/1989 | Morris | 138/99 |
| 5,148,835 | 9/1992 | Clark | 138/96 |
| 5,288,108 | 2/1994 | Eskew et al. | 138/96 T |
| 5,368,074 | 11/1994 | Hall | 138/96 |

FOREIGN PATENT DOCUMENTS

| | | |
|---|---|---|
| 1579154 | 6/1977 | United Kingdom . |
| 2038273 | 7/1980 | United Kingdom . |

*Primary Examiner* Frankie L. Stinson
*Assistant Examiner* James F. Hook
*Attorney, Agent, or Firm* Matthews & Assoc.; J. Albert Riddle

[57] ABSTRACT

A thread protector has a toroidal body of elastomer with a bore to accept a pipe end and a metal band and clamp arrangement extending around its periphery. The body is cut through one side to allow the body to expand peripherally. The bore accepts the end of a pipe with threads to be protected when the periphery is expanded and grips the pipe with the bore when the clamp closes the cut and shrinks the bore. To increase unit loading to force more elastomer of the body into thread grooves the bore has projections for gripping pads, or is recessed radially to produce gripping pads. The pads, which may be replaceably attached, reduced area increases deformity under clamping pressure and increases the force required to dislodge the protector from threads. The metal band is removable from an open peripheral groove or an optional arcuate tunnel partially encircling the pad body.

13 Claims, 3 Drawing Sheets

CASING THREAD PROTECTOR

This invention pertains to thread protectors for threads at the ends of tubular goods. More specifically, but not in a limiting sense, the thread protector is intended for short term installation on male threads on well pipe joints being handled between horizontal racks and a well derrick. Elastomeric housings and metal securing features with quick release capability characterize protectors of the class disclosed.

BACKGROUND

Tubular goods for installation in wells experience considerable handling and storage between steel mill and well and a cylindrical thread protector normally stays on every male thread until it reaches the well site. These are screw on protectors and have a full complement of threads. It takes a number of turns to remove the original protector and that expenditure of time cannot be tolerated during installation of tubular strings in wells. The original protector is removed at the well site and a quick releasing one is installed. It rides from rack to rig and is removed when the joint is to be threadedly attached to the downwardly continuing string. During the interval that the protector is on threads, a last bore drift test is usually done and it is desirable that the protector does not interfere with the drift passage.

A considerable amount of development work has been done in efforts to improve the bands and related tensioning gear to keep the casing protectors from being knocked off the thread during the rack to well trip.

The body of protectors in rig site use are currently made of elastomer, usually polyurethane, but sometimes black rubber. The elastomer is formulated and cured to serve the skid and bash protection function and does not always favor thread gripping. The elastomer would grip threads if enough hoop force were applied by the securing bands. The securing bands that are closed by hand have limited energy available and do not drive the elastomer into the thread grooves sufficiently to prevent occasional slipping of the protector.

It is therefore an object of this invention to provide an elastomeric thread protector with higher unit loading to more effectively urge the elastomer into the thread grooves yet allow drift testing of the pipe bore.

It is another object of this invention to provide replaceable elements subject to the higher unit loading to reduce the frequency of total body losses due to thread load induced damage.

It is yet another object of this invention to provide a tensioning hoop band for closing thread protectors on pipe threads that is readily replaceable when damaged to preserve the elastomeric body.

These and other objects, advantages, and features of this invention will be apparent to those skilled in the art from a consideration of this specification, including the attached claims and appended drawings.

SUMMARY OF THE INVENTION

The protector has an elastomer body of generally toroidal shape common to a doughnut. The toroid is cut by a plane containing the axis of symmetry and extending from the axis outward. This allows the body bore to expand to accept the pipe to be protected. A circumferential tensioning band of metal is carried in a peripheral groove about the body. The band is closed across the cut gap by a toggle clamp. The closed body has a generally cylindrical bore approximating the size of the pipe outside dimension. A salient feature of this protector is a complement of pads extending radially inward from the bore to engage the threads of the pipe. This reduces contact area and increases unit load. Additionally, the pads do not necessarily have the physical characteristics of the general body and can be devised to optimize the extrusion of elastomer into thread grooves, and can be provided of soft metal or plastic with grooves to engage threads.

The pads are replaceable and are attached to the body by releasable means optionally including grooves for a composite pad set, dovetails for each pad, and enlarged adhesive junctures.

BRIEF DESCRIPTION OF DRAWINGS

In the drawings wherein like symbols refer to similar features.

DETAILED DESCRIPTION OF DRAWINGS

Figure 1A:
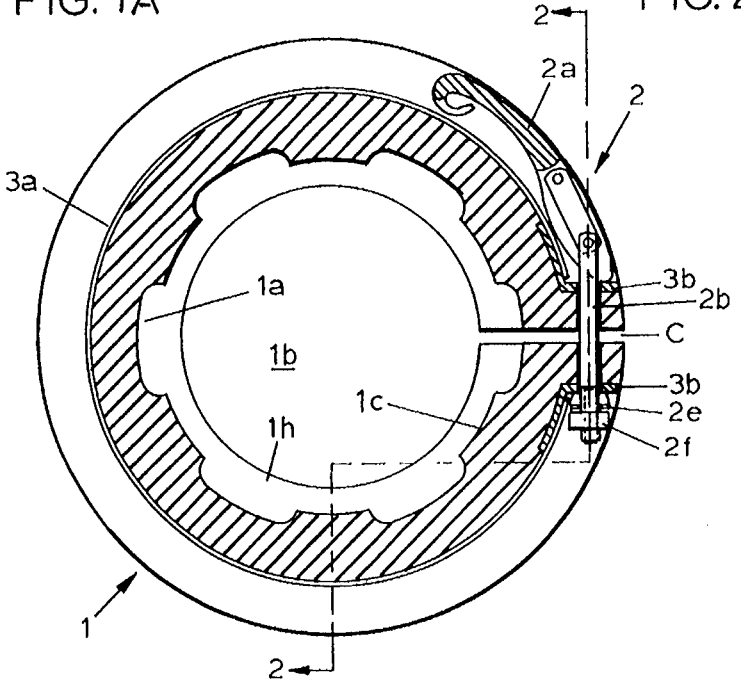
FIG. 1A is an elevation viewed along the axis of pipe to be protected.

In FIG. 1A, doughnut shaped body 1 has cut C to allow the body to gape open to release pipe threads gripped by pads 1*c* in bore 1*a*. The cut is closed and held on pipe by toggle clamp 2 which applies tension to band 3 to apply radial force between pads 1*c* and the threads to be protected. Bore 1*b* is about the same diameter as the casing bore and provides plane 1*h* to stop and position pipe entering the bore 1*a*.

Figure 1B:
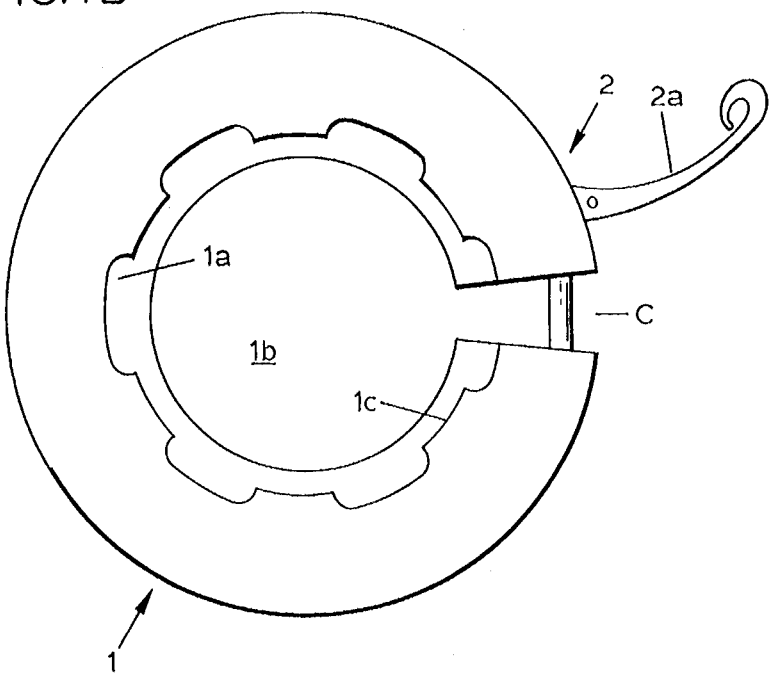
FIG. 1B is an unsectioned view similar to FIG. 1A in the alternate position, open to release pipe.

In FIG. 1B clamp 2 has been actuated to open the cut C and increase the periphery of the cylinder defined by surfaces on pads 1*c* to release threads when gripped and for installation on threads to be protected.

Figure 2:
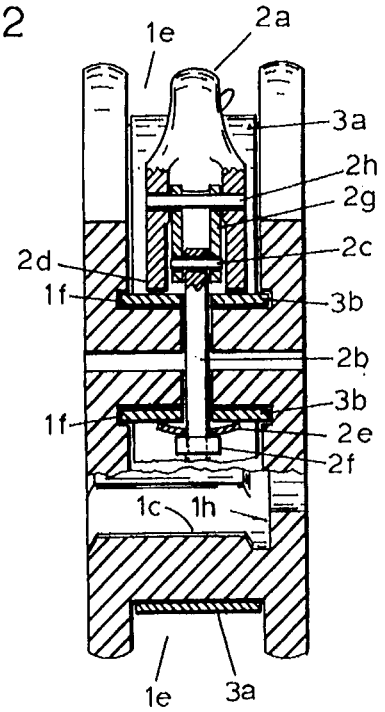
FIG. 2 is a right side view, partly sectioned, of the protector of FIG. 1A.

In FIG. 2, an orthogonal projection of FIG. 1A, the toggle clamp 2 is shown with cams 2*b* bearing upon band plate, or terminal, 3*b*. Clamp lever 2*a* is attached to the cam structure 2*d* and pivots about pin 2*h* to allow links 2*g* to relax thrust on pin 2*c* and bolt 2*b*. Clamp bolt 2*b* extends through adjusting nut 2*f* which loads optional spring (or spring washer) 2*e* which bears upon band plate 3*b*. The band and clamp arrangement is old art using the toggle or over-center self locking feature. Band 3*a* is carried in recess 1*e* which extends around most of the body periphery. The band can, optionally, be imbedded in the body elastomer. Band plates 3*b* are peripherally captured in grooves 1*f*. If bolt 2*d* is removed, plates 3*b* can be slid radially outward along the grooves to free the band 3. On most protector sizes the resilience of the pads 1*c*, flexed more by higher unit loading than would occur by engaging pipe with the full periphery, eliminates the need for the spring 2*e* and it is replaced by a flat washer.

In FIG. 1A the bore 1*a* is achieved by radial cutouts (either cut or molded) to relieve the original bore which produced cylindrical surfaces on pads 1*c*. This arrangement is suitable when pad elastomer can be identical to that of the general body.

FIGS. 3 through 8 represent alternate constructions of thread engagement pads represented by the lower portion of FIG. 2 and the related section on FIG. 1A.

Figure 3:
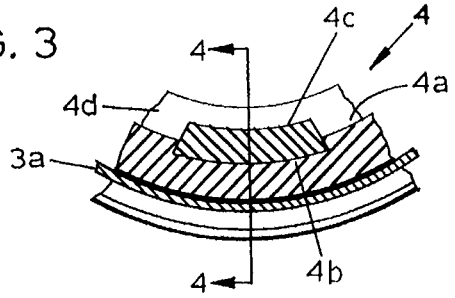
FIG. 3 is a sectional view of a selected area of FIGS. 1A and 2.
Figure 4:
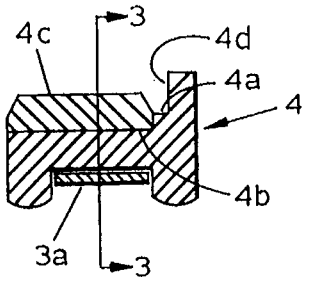
FIG. 4 is a sectional view taken along line 4—4 of FIG. 3.

In FIGS. 3 and 4, pad insert 4*c*, confined in recess 4*b* of body 4, projects inwardly from bore 4*a*. Bore 4*a* does not need to touch the pipe being protected. Flange 4*d* locates the pipe end but has no further purpose in the gripping of pads 4*c*. Flange 4*d* does prevent a pipe end impact from forcing the pad to slip on threads.

Figure 5:
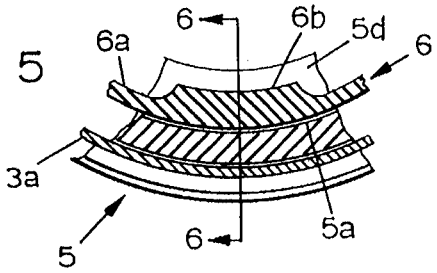
FIG. 5 is a sectional view similar to that of FIG. 3 but showing an alternate form of one feature of the invention.
Figure 6:
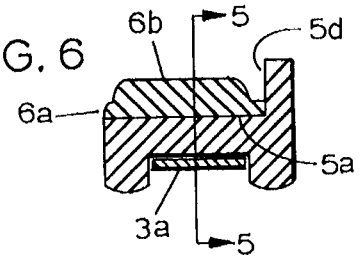
FIG. 6 is a sectional view taken along line 6—6 of FIG. 5.

FIGS. 5 and 6 show alternate means for securing pads 6*b* to body 5. The pads 6*b* are formed on a circular band 6*a* from which they extend radially inward. The formed band 6, with pads 6*b*, is then secured to the surface of bore 5*a* and cut at the location of the body cut C (FIG. 1). Mechanical fastening, adhesive, or a combination of the two is used to secure the band in the bore. Shoulder 5*d* serves to position pipe.

Figure 7:
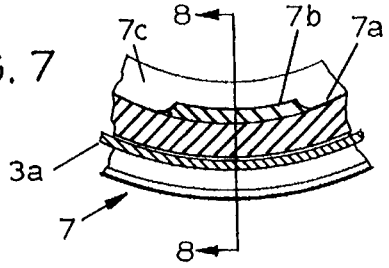
FIG. 7 is a sectional view, similar to that of FIG. 5, of an alternate form of the invention.
Figure 8:
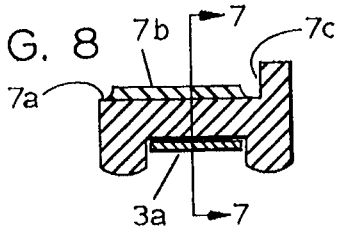
FIG. 8 is a sectional view taken along line 8—8 of FIG. 7.
Figure 10:
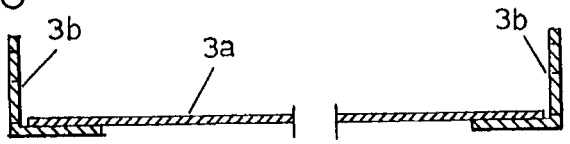
FIG. 10 is a sectional view taken along line 10—10 of FIG. 9.
Figure 11:
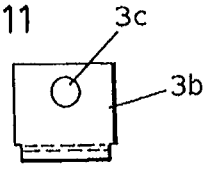
FIG. 11 is a right end view of the component of FIG. 10.
Figure 9:
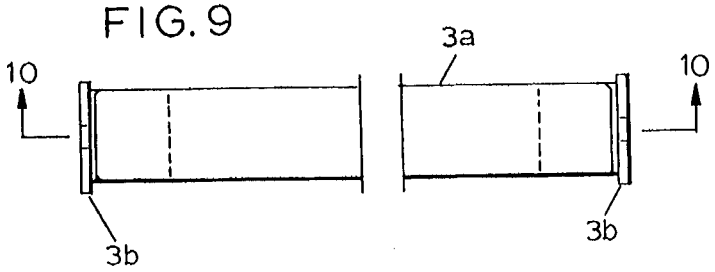
FIG. 9 is an elevation of component common to FIGS. 1A through 12.

FIGS. 7 and 8 show a sectioned body 7 without grooves or slots for pad inserts. Pad 7*b* is shaped to increase the surface area available for adhesive to join pad and body. Surface 7*a* can be the cylindrical form produced by the bore 1*a* (FIG. 1) or it can be shaped to define the location of the pads for their distribution about the periphery of pipe to be gripped. Flange 7*c* does the usual pipe locating.

Figure 12:
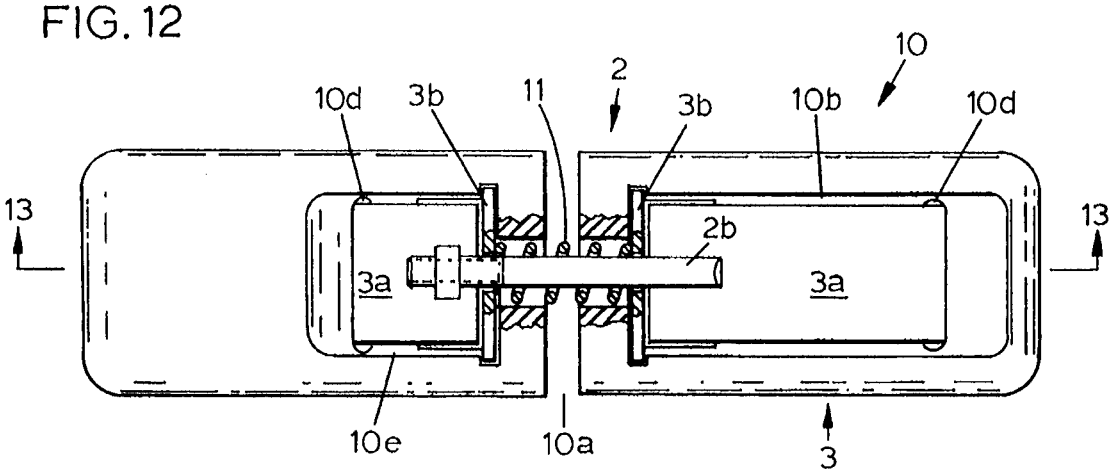
FIG. 12 is an elevated view of an alternate body configuration.
Figure 13:
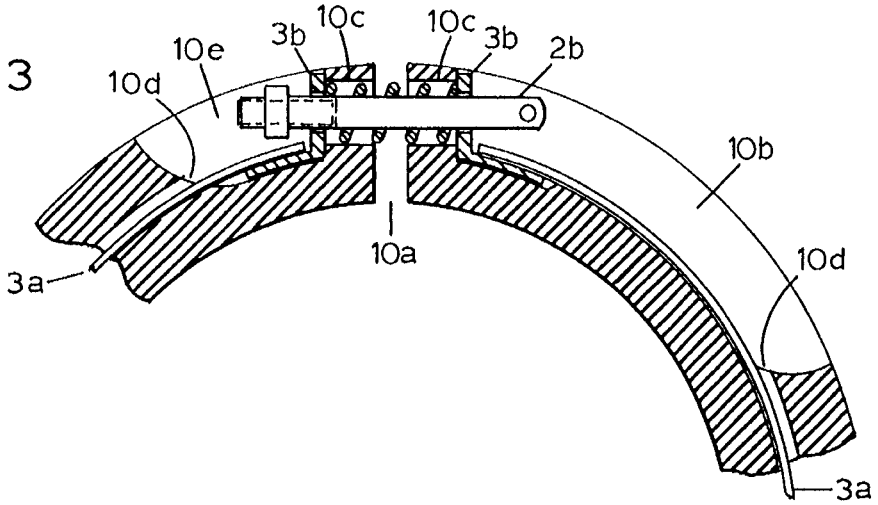
FIG. 13 is a sectional view taken along line 13—13 of FIG. 12.

The general construction and alternate operational positions having been shown for the preferred embodiment of the invention, FIGS. 12 and 13 are shown without alternate positions and without some of the clamping details.

FIGS. 12 and 13 represent an alternate body construction, preferred on larger size protectors, in which the peripheral band is partially enclosed within a body tunnel and rapid opening is assured by an independent opening spring. On larger protectors, the peripheral groove that accepts the peripheral band is eliminated to attain greater rigidity.

Body 10 has recess 10*b* for the usual toggle clamp handle and the shorter recess 10*b* for one band terminal 3*b*. Recess 10*b* is long enough to permit attachment of one 3*b* terminal after the band is inserted through the tunnel 10*d*. The riveting or fixture brazing method is preferred for attaching the final terminal. The band is still removable by cutting it in the recess 10*b* after the bolt 2*b* is removed to allow the band to swing outward.

Spring 11, an optional feature, is inserted into openings 10*c* before the bolt is installed. Cut 10*a* is shown almost closed in preparation for installation of the clamp handle and related links connectable to bolt 2*b*.

Spring 11 is shown to act against terminals 3*b*. This spring can be replaced by two springs in separate openings, one on each side of the bolt in axially separated openings.

The body bore 10*e* is shown without the grip enhancing features of FIGS. 1*a* and FIGS. 3 through 8. These features have been disclosed herein and can be used as desired for this optional body configuration.

From the foregoing, it will be seen that this invention is one well adapted to attain all of the ends and objects hereinabove set forth, together with other advantages which are obvious and which are inherent to the protector.

It will be understood that certain features and sub-combinations are of utility and may be employed without reference to other features and sub-combinations. This is contemplated by and is within the scope of the claims.

As many possible embodiments may be made of the protector of this invention without departing from the scope thereof, it is to be understood that all matter herein set forth or shown in the accompanying drawings is to be interpreted as illustrative and not in a limiting sense.

The invention having been described, we claim:

1. An improved pipe thread protector for temporary use on male threads of well pipe, the protector comprising:

an elastomeric body member, said body member being substantially cylindrical with open ends, an inner face and an outer face;

a longitudinal cut formed in said body member extending completely through said body member said cut defining opposed faces;

a channel formed in said outer face of said body member;

clamp means generally maintained within said channel, said clamp means encircling the periphery of said body member and being able to actuate said body member between an open position permitting some separation between the opposed faces of said longitudinal cut and a closed position with less separation between said faces; and A plurality of spaced longitudinally positioned discrete thread engagement pads extending radially along said inner face of said body member, such that any engagement with said threads is limited to said engagement pads.

2. The protector of claim 1, wherein said engagement pads are replaceable.

3. The protector of claim 1, further comprising a channel formed along the outer face of said body member wherein said clamp means is positioned.

4. The protector of claim 1, wherein grooves are formed on the inner face of said body member such that said engagement pads are individually retained on said body.

5. The protector of claim 1, wherein said engagement pads are connected to an arcuate band, said band arranged for attachment to the inner wall of said body member.

6. The protector of claim 1, wherein said engagement pads are individual inserts arranged for adhesive attachment to the inner face of said body member.

7. The protector of claim 1, wherein said clamp means comprises a flexible strap placed around the outer face of said body member wherein said flexible strap has end terminals connected by a toggle clamp arranged to change the separation between said terminals, said terminals being attached to said body member.

8. The protector of claim 1, wherein said clamp means is, at least in part, embedded in said body member.

9. The protector of claim 1, wherein said body is composed, at least in part, of elastomer.

10. The protector of claim 1, wherein a flange is integrally formed at one end of the cylindrical body member against which the pipe being protected may rest when said thread protector is in use.

11. A thread protector for use on pipe to protect male threads the protector comprising:

a generally cylindrical body of elastomer with a longitudinal bore therethrough defining an inner face and outer face;

a radially directed cut through the entirety of said body;

a band and clamp means mounted about the outer face of the cylindrical body, said band and clamp means arraigned to actuate between an open and a closed position for opposing faces of said body member defined by said cut;

said band situated, at least in part, in and removable from a channel defined about the outer face of said body member;

a plurality of discrete thread engagement pads mounted about the inner face of said cylindrical body so as to decrease the diameter of said boar of said body member.

12. The thread protector of claim 11, wherein said band comprises a metal strip with terminals at each end, said terminals joined by said clamp means.

13. The protector of claim 12, wherein said terminals are attached to said body member to assure simultaneous movement of said body and said band between said closed and open positions.

* * * * *